US005580222A

United States Patent [19]

Bornemann

[11] Patent Number: 5,580,222

[45] Date of Patent: Dec. 3, 1996

[54] LIQUID RING VACUUM PUMP AND METHOD OF ASSEMBLY

[75] Inventor: Alfred H. Bornemann, Milton, Mass.

[73] Assignee: Tuthill Corporation, Hinsdale, Ill.

[21] Appl. No.: 161,852

[22] Filed: Dec. 3, 1993

[51] Int. Cl.[6] ..... F04C 19/00

[52] U.S. Cl. ..... 417/68; 417/244; 415/214.1

[58] Field of Search ..... 417/68, 238, 244; 415/214.1

[56] References Cited

U.S. PATENT DOCUMENTS

| | | | |
|---|---|---|---|
| 4,273,515 | 6/1981 | Fitch | 417/68 |
| 4,795,315 | 1/1989 | Schultze | 417/68 |
| 5,356,268 | 10/1994 | Lengyel et al. | 417/68 |

FOREIGN PATENT DOCUMENTS

| | | | |
|---|---|---|---|
| 3809929 | 10/1989 | Germany | 417/68 |

*Primary Examiner*—Charles Freay
*Attorney, Agent, or Firm*—Lee, Mann, Smith, McWilliams, Sweeney & Ohlson

[57] ABSTRACT

A method for assembling a pump assembly which comprises: placing a drive end assembly about a shaft having centrally disposed shoulder the diameter of which is greater than the mean diameter of the shaft, the shoulder having a first side wall and a second side wall wherein the drive end assembly is adjacent to the first side wall of the shoulder; placing a center housing about the shoulder and adjacent to the drive end assembly; affixing the drive end assembly to the center housing by at least one tie rod; placing a non-drive end assembly about the shaft wherein the non-drive end assembly is adjacent to the second side wall of the shoulder; and affixing the non-drive end assembly to the center housing by at least one tie rod, whereby the drive end assembly is assembled and/or disassembled about the shaft independent of the non-drive end assembly.

18 Claims, 5 Drawing Sheets

LIQUID RING VACUUM PUMP AND METHOD OF ASSEMBLY

The present invention relates generally to liquid ring vacuum pumps which include multiple impellers disposed about central shaft and a method of assembling the same. This unique pump is designed such that each impeller assembly may be assembled or disassembled independent of the other impeller.

BACKGROUND OF THE INVENTION conventional liquid ring vacuum pumps comprise multiple impellers and an adjustable spacer bushing disposed between the impellers. The removable impellers and spacer are secured about the shaft by means of a locknut which is disposed at one end of the shaft and a shaft shoulder which is disposed at the opposite end of the shaft.

One conventional method for assembling a liquid ring vacuum pump as shown in FIG. 1, comprises the attaching of a first stage endcasing 1 to a bearing housing 11 which includes a ball bearing 17. Endcasing 1 and bearing housing 11 are thereafter mounted on an assembly stand 100 for vertical assembly of pump 110. Side plate 3 is then attached to endcasing 1 (screws are not shown). Center shaft 12 having a shaft shoulder 120 disposed at one end thereof is inserted vertically into bearing 17. After inserting key 19 into shaft 12, a first stage impeller 7 is fitted about shaft 12 such that shaft shoulder 120 is disposed between impeller 7 and side plate 3. It should be noted that key 19 and impeller 7 can alternatively be mounted about shaft 12 prior to insertion of shaft 12 into bearing 17. Thereafter, first stage impeller housing 9 is affixed to side plate 3, while suction plate 5 and discharge plate 4 are joined to form a center housing. Plates 4 and 5 are then affixed to first stage impeller housing 9. Alternatively, plates 4 and 5 can be formed as a one piece center housing which is also affixed to impeller housing 9. An impeller spacer bushing 30 is disposed on shaft with clearance to the inside diameters of suction plate 5 and discharge plate 4.

After installing key 20 on shaft 12, a second stage impeller 8 is mounted about shaft 12. Second stage impeller housing 10 is connected to plates 4 and 5 such that it encases second stage impeller 8. Thereafter, an impeller locknut 31 is placed about shaft 12 and tightened via threads disposed on the surface of shaft 12. The tightening of locknut 31 secures impellers 7 and 8 and spacer 30 as a single unit against shaft shoulder 120. Separately, side plate 6 is fastened to second stage endcasing 2 which is then fastened to non-drive end bearing housing 122 with radial alignment of feet disposed at the bottom of endcasing 2 and top flanges connected to conduit 28.

A set of continuous tie 23, only one shown by ways of example, are installed between endcasings 1 and 2 and torqued to join the entire pump assembly. Conversely, when tie rods 23 are loosened in order to repair or perform periodic maintenance on pump 110 the entire pump 110 is disassembled. That is, endcasings 1 and 2, impellers 7 and 8, and spacer bushing 30 will separate from each other upon the loosening of tie rods 23 such that they must be resealed and adjusted before reassembling pump 110 and re-tightening of tie rods 23.

Assembly of such a conventional pump as shown in FIG. 1 (i.e., in the vertical mode) requires stacking of all of the static housing components with intermediate gaskets or sealant, and the rotating shaft/impeller parts before securing the entire assembly together by means of various tie rods disposed between the endcasings of both the drive and the non-drive ends of the shaft. Impeller end clearances are difficult to equalize and control during this systematic layer-upon-layer assembly method. Moreover, during disassembly or repair the entire pump must be broken down and all sealing joints have to be redone prior to reassembling of the pump.

The present invention provides a unique pump assembly which overcomes the assembly/disassembly problems associated with conventional pumps by permitting the independent assembly and disassembly of each impeller stage about the shaft. This is accomplished by mounting each impeller on the shaft on opposite sides of a novel fixed center shaft shoulder and thereafter securing each impeller in place by means of its associated locknut. A plurality of tie rods (i.e., securing means) are independently secured between the center housing and each respective first and second stage endcasings. This allows for the independent assembly or disassembly of each static housing side (i.e., either the static first stage housing side or static second stage housing side), whereby each impeller can be independently repaired or replaced without requiring the disassembling of the other impeller unit. The independent assembly of either impeller unit results in a substantial savings in terms of both repair time and material costs versus conventional pumps which require the replacement of gaskets and sealings and re-alignment of the non-repaired impeller unit whenever the pump is disassembled.

The present invention provides for an easier assembly/disassembly of liquid ring vacuum pumps, as well as enables proper control of critical end clearances between the impeller and their associated endcasing.

The present invention also provides many additional advantages which shall become apparent as described below.

SUMMARY OF THE INVENTION

A pump assembly which comprises a shaft having a centrally disposed shoulder means with a diameter which is greater than the mean diameter of the shaft, the shoulder means having a first side wall and a second side wall; a drive end assembly which comprises a first endcasing, a first bearing housing, a first impeller housing and a first impeller means, wherein the drive end assembly is disposed about the shaft such that the first impeller means is adjacent to the first side wall of the shoulder means; first locking means for securing the first impeller means against the shoulder means; a center housing disposed about the shoulder means of the shaft and adjacent to the drive end assembly; at least one first securing means disposed between the drive end assembly and the center housing for affixing the drive end assembly to the center housing; a non-drive end assembly which comprises a second endcasing, a second bearing housing, a second impeller housing and a second impeller means, wherein the non-drive end assembly is disposed about the shaft such that the second impeller means is adjacent to the second side wall of the shoulder means; a second locking means for securing the second impeller means against the shoulder means; and at least one second securing means disposed between the non-drive end assembly and the center housing for affixing the non-drive end assembly to the center housing.

The first securing means is a tie rod which is threadably connected to the center housing and mechanically connected to the first endcasing of the drive end assembly, whereas the second securing means is a tie rod which is threadably connected to the center housing and mechanically connected to the second endcasing of the non-drive end assembly.

The impellers having a plurality of blades and a rib means which is capable of connecting all of the blades together. The preferable number of blades of the impeller is thirteen. The blades typically have an arcuate configuration.

A method for assembling a pump assembly which comprises: placing a drive end assembly about a shaft having a centrally disposed shoulder means with a diameter which is greater than the mean diameter of the shaft, the shoulder means having a first side wall and a second side wall wherein the drive end assembly is adjacent to the first side wall of the shoulder means; placing a center housing about the shoulder means and adjacent to the drive end assembly; affixing the drive end assembly to the center housing by at least one first securing means; placing a non-drive end assembly about the shaft wherein the non-drive end assembly is adjacent to the second side wall of the shoulder means; and affixing the non-drive end assembly to the center housing by at least one second securing means, whereby the drive end assembly is assembled and/or disassembled about the shaft independent of the non-drive end assembly.

Other and further objects, advantages and features of the present invention will be understood by reference to the following specification in conjunction with the annexed drawings, wherein like parts have been given like numbers.

DESCRIPTION OF THE PREFERRED EMBODIMENTS

Liquid ring vacuum pumps are designed for use when low vacuum is required, processes are wet, vapor loads are high, slugs of liquid or condensate are involved, processes are corrosive, process solvent can be used as pump fluid, vapor recovery is required or when gas temperatures are high.

The liquid ring vacuum pump uses a rotating ring of liquid as a sealant. The liquid ring is created by the centrifugal force generated by the rotating impellers. This centrifugal force holds the ring against the inner wall of the cylindrical pumping chamber. Since the impeller shaft is eccentric to the pumping chamber, the depth of entry of the blades into the liquid ring decreases and increases as the impeller rotates. This creates a constantly increasing gas space between the impeller blades as they pass the inlet port and a constantly decreasing gas space between the blades as they approach and pass the discharge port. As a result, gas is drawn into the pumping chamber, compressed, and discharged. Compound or multi-stage pumps can achieve lower absolute pressures than single stage pumps, the first stage impeller acts to suction gas, compress the gas and discharge it into the second stage where its impeller act to further compress the gas and discharge it via the discharge side plate to the discharge port of the pump.

Most liquid ring vacuum pump applications discharge against atmospheric pressure, however, they can also discharge against low positive pressure. With modification the pump's discharge pressure can be increased further to act as a low pressure compressor.

Figure 1:
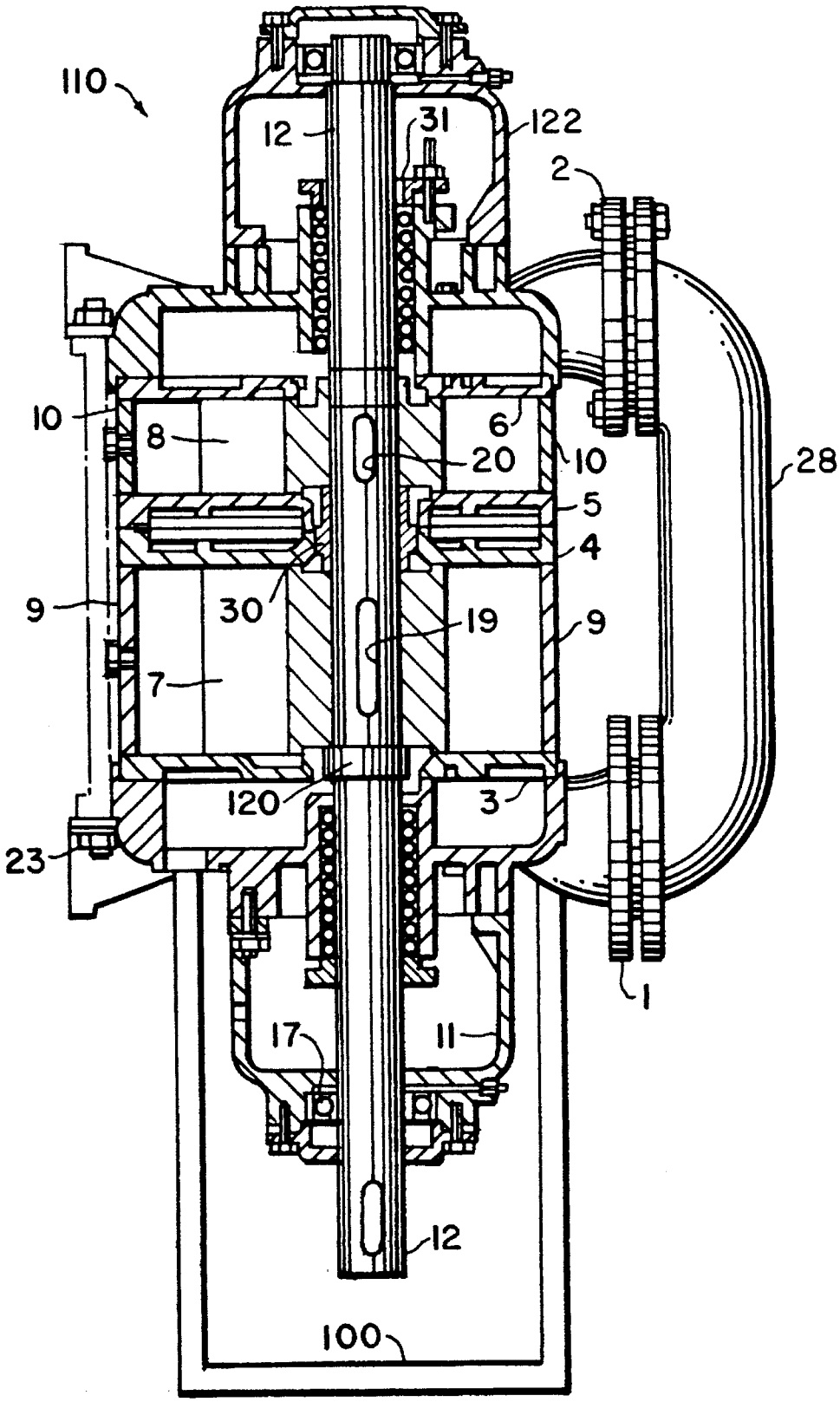
FIG.1 PRIOR ART
FIG. 1 is a cross-sectional view of a conventional liquid ring vacuum pump assembly.
Figure 2:
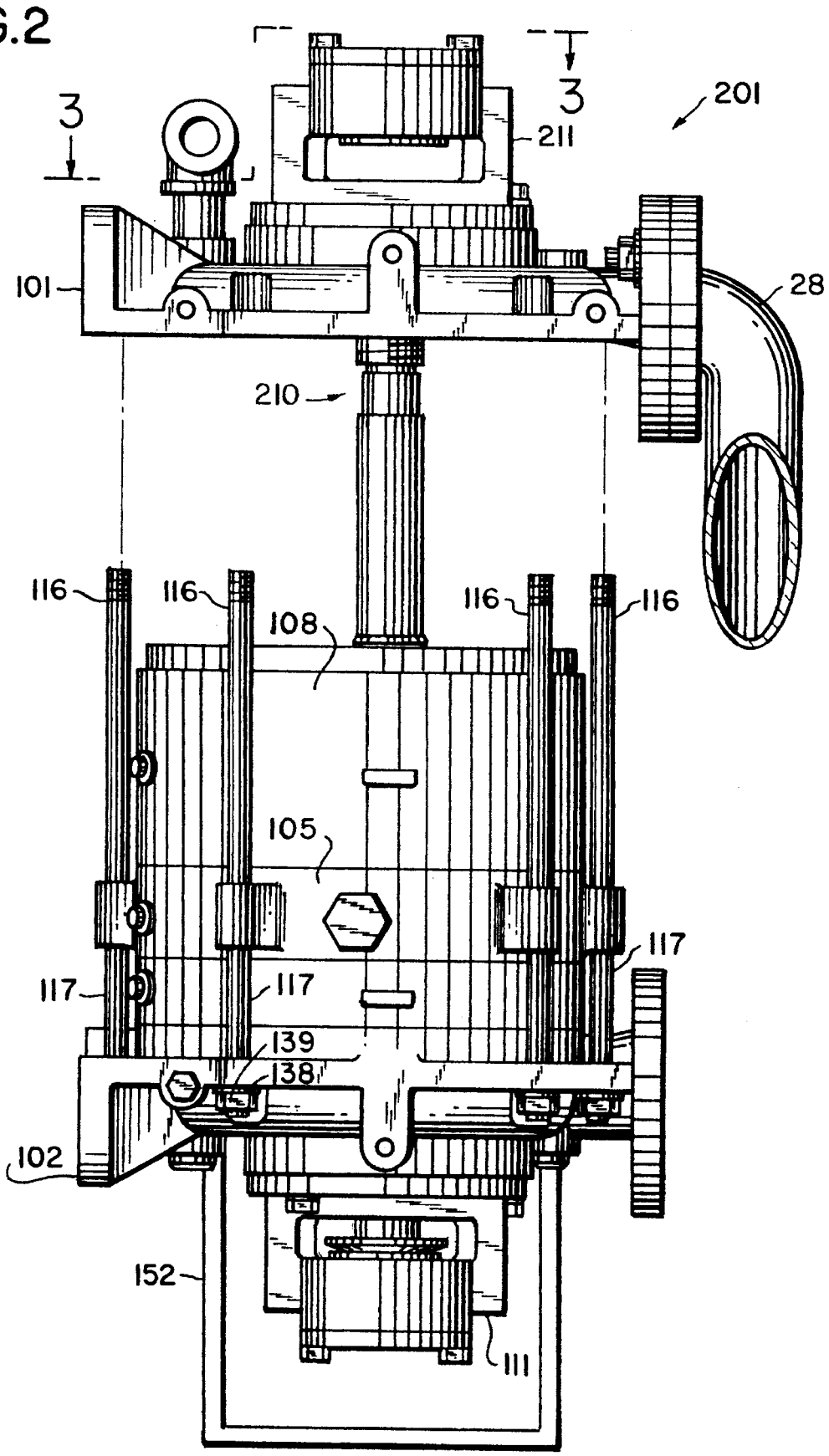
FIG. 2 is an exploded elevational view of a liquid ring vacuum pump assembly wherein the drive end endcasing has been removed in accordance with the present invention.
Figure 3:
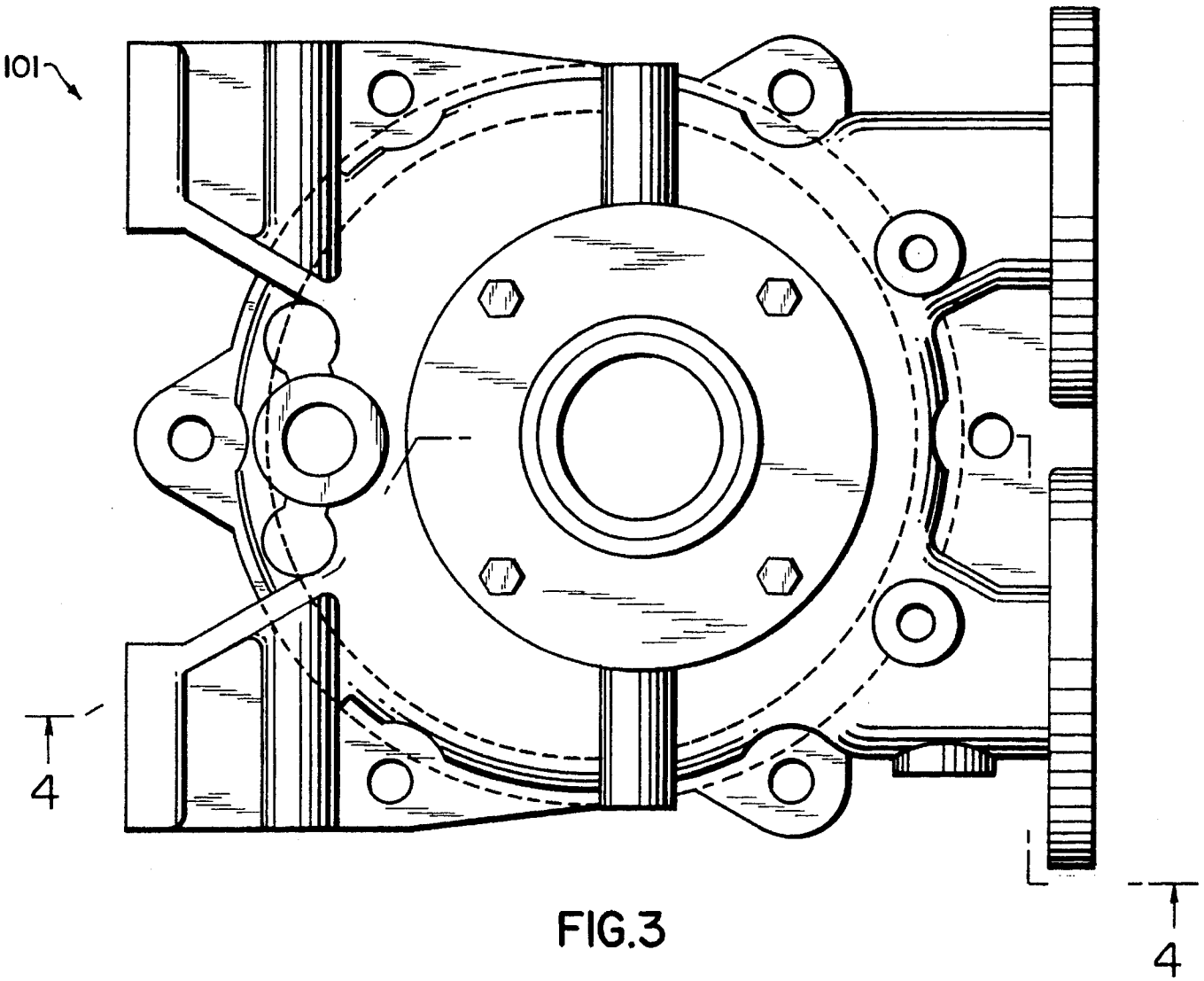
FIG. 3 is a top plan view of FIG. 2.
Figure 4:
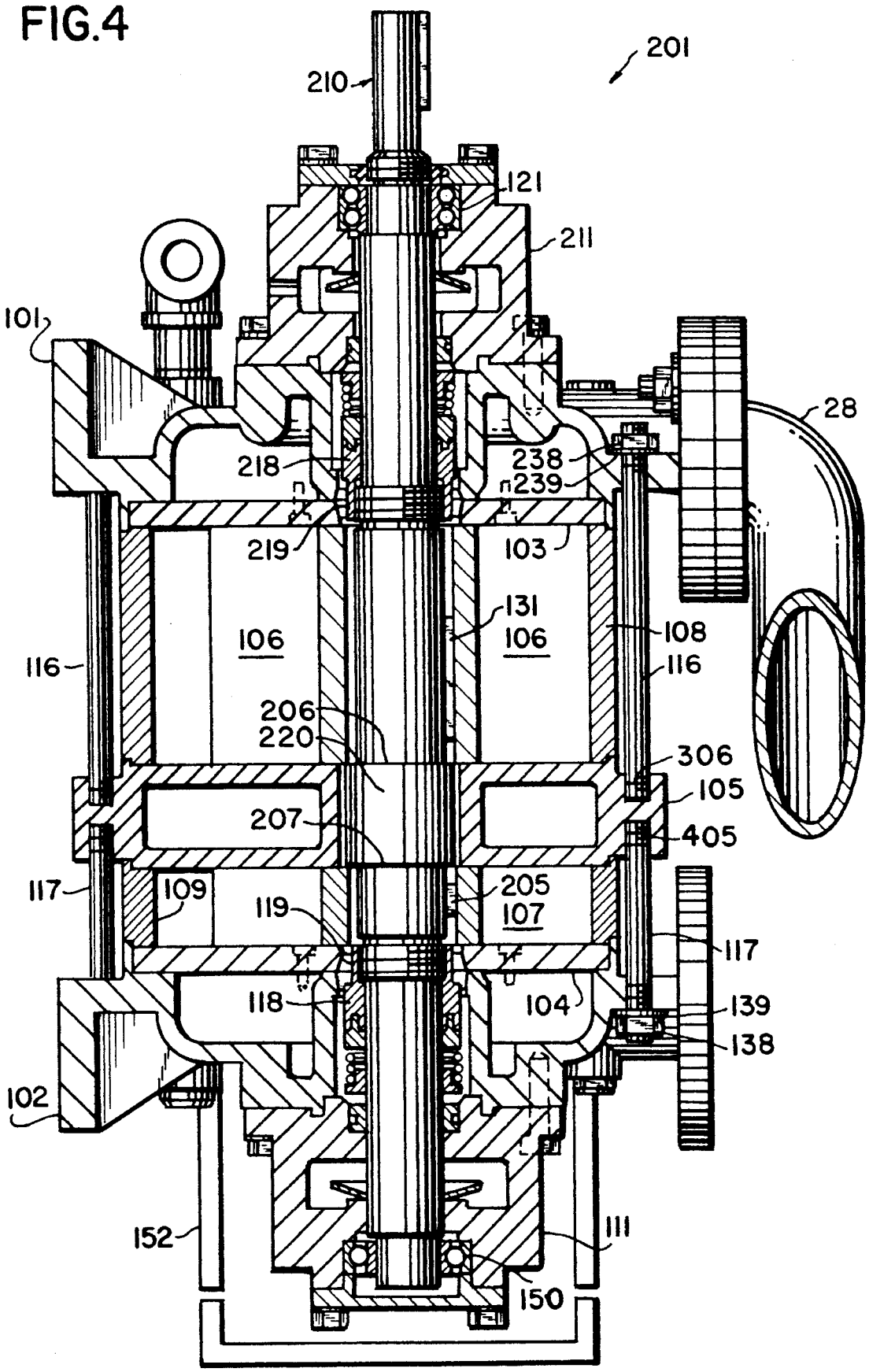
FIG. 4 is a cross-sectional view across line 4—4 of the liquid ring vacuum pump assembly of FIG. 3.

The present invention can best be described by referring to the drawings wherein FIGS. 2–4 depict the liquid ring vacuum pump assembly in accordance with the present invention. The vacuum pump assembly according to the present invention comprises two impeller assemblies disposed on opposite sides of a center housing such that they may be independently mounted on the same central shaft. The shaft has a fixed central shoulder of greater diameter than the rest of shaft, wherein each drive end or non-drive end assembly is mounted on opposite sides of the shoulder. Each drive end or non-drive end assembly is also provided with a means for independently affixing each assembly to the center housing, whereby each drive end or non-drive end assembly may be assembled and/or disassembled independent of the other assembly.

The pump 201 is assembled by placing the non-drive end (NDE) second stage endcasing 102 with attached bearing housing 111 comprising a bearing 150, onto an assembly stand or fixture 152 for vertical assembly. NDE (second stage) end plate 104 is fastened to endcasing 102. The NDE (second stage) key 205 and NDE (second stage) impeller 107 are placed onto shaft 210 such that impeller 107 is adjacent to side wall 207 of shoulder 220. Impeller 107 is secured to shaft 210 by impeller nut (e.g., locknut) 118 and impeller retaining washer 119. Thereafter, the assembly which comprises second stage impeller 107, key 205, impeller nut 118, and impeller retaining washer 119, mounted about the non-drive end of shaft 220, is then inserted through an opening in end plate 104 into bearing 150. NDE (second stage) impeller housing 109 is located on NDE plate 104.

Tie rods 117 are secured to center housing 105 via radial tie rod thread holes 405. Center housing 105 and tie rods 117 are then connected to endcasing 102 by means of hex nuts 138 and washers 139.

Drive end (DE) (first stage) key 131 is placed into shaft 210 and then first stage impeller 106 is mounted onto shaft 210 by positioning impeller nut retaining washer 219 on top of first stage impeller 106 followed by screwing impeller nut 218 against retaining washer 219 and impeller 106 which securely affixes first stage impeller 106 against fixed center shaft shoulder 220, wherein impeller 106 is held adjacent to side wall 206 of shaft shoulder 220. Impeller housing 108 is then connected to center housing 105.

DE end plate 103 is separately and independently fastened onto DE endcasing 101. DE endcasing 101 and DE end plate 103 are then placed onto impeller housing 108, aligning tie rods 116, which have previously been screwed into thread holes 306 of center housing 105, with through holes disposed on endcasing 101. Center housing 105 and endcasing 101 are securely affixed together by simply tightening nuts 238 and washers 239 on the drive end of tie rods 116. DE bearing housing 211 is then connected to DE endcasing 101 by any conventional mechanical means.

When it is necessary to disassemble the pump 201, either nuts 138 and washers 139 on the non-drive end or nuts 238 and washers 239 on the drive end of the tie rods 117 and 116, respectively, are removed depending upon whether the drive end assembly or non-drive end assembly requires maintenance or replacement. For example, if it is necessary to replace impeller 107, then nuts 138 and washers 139 would be removed from tie rods 117. Thereafter, second stage endcasing 102, bearing housing 111 and end plate 104 would be removed from pump assembly 201 as a single unit, thereby obtaining direct access to second stage impeller 107. Thereafter, if it is required to remove second stage impeller 107, then locknut 118 is removed and impeller 107 is simply slid off of shaft 210. As such, impeller 107 can be removed or repaired without affecting the drive end assembly or the positioning of impeller 106. This saves a substantial amount of time during the servicing of the pump, as well as the added cost of replacing all of the gaskets and seals associated with the impeller not requiring service.

Conversely, if first stage impeller 106 requires attention, then it too may be separately and independently accessed without disturbing the second stage non-drive end assembly. To the contrary, conventional liquid ring vacuum pumps all require the disassembling of the entire pump during the servicing of one or the other impellers.

Figure 5:
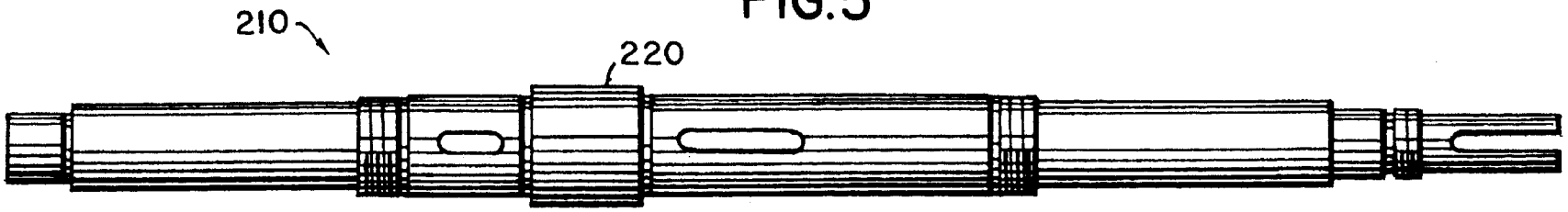
FIG. 5 is a view of the pump shaft with a fixed center shaft shoulder.

FIG. 5 depicts a shaft 210 having a fixed center shaft shoulder 220 which has a diameter which is larger than the mean diameter of shaft 210. By having a larger diameter, shaft shoulder 220 allows the first and second stage impellers to be mounted on opposite side walls of shoulder 220 without affecting the oppositely disposed impeller assembly. In conventional pumps, the shaft shoulder is disposed at one or the other end of shaft 220 and the impellers are separated, not by a fixed center shoulder, but by a removable spacer bushing, thereby requiring reassembling of both the first and second stage impeller assemblies upon the repair or replacement of either impeller.

Any conventional impeller may be used in the pump assembly, i.e., straight blade impellers, curved blade impellers, ribbed blade impellers, non-ribbed blade impellers. Of all the impeller features the ribbing is the most critical. Impellers without ribs, and with rather thin blades, are subject to more frequent failure. When liquid ring pumps are improperly operated, slugs of liquid can overload and deform the blading, thereby occasionally causing the pump to seize. Another advantage of ribs is that they rigidize the blades during machining, without them it is a very noisy process.

Figure 6:
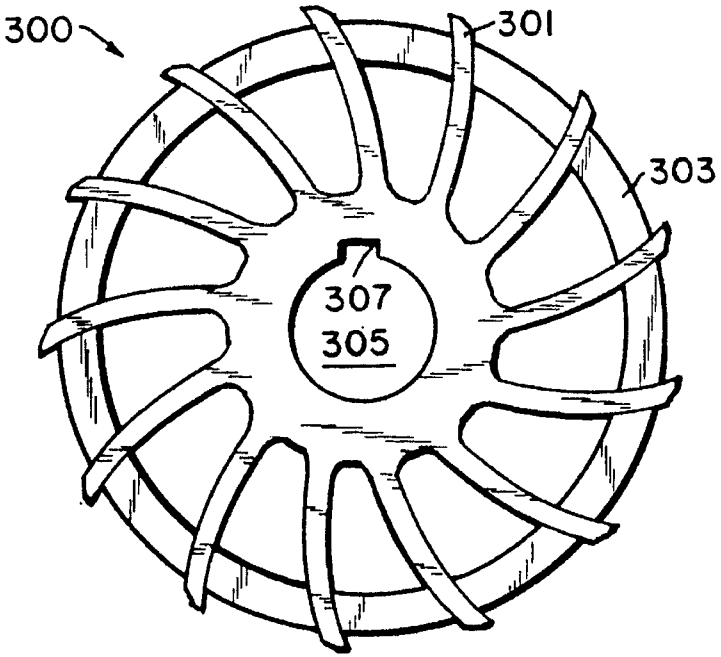
FIG. 6 is a top plan view of a multi-blade impeller used in accordance with the present invention.

As shown in FIG. 6, the preferred impeller design is made with blades 301, which have a heavier thickness than conventional impeller blades without loss of net pumping cavity. Maintaining the pumping cavity of the impeller assembly is achieved by using thirteen blades 301 instead of other conventional amounts, such as fifteen. Another unique feature of the thirteen bladed-impeller 300 is the fact that all of the blades 301 are connected by a common rib 303. This avoids the imbalance which would result from irregularly spaced ribs. Impeller 300 includes a center hole 305 having a key notch 307 for securely mounting it about the rotating shaft of the liquid ring vacuum pump. The keys disposed in the shaft fit within key notch 307 such that impeller 300 rotates together with the shaft during normal operation of the pump.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A pump assembly which comprises:

a shaft having centrally disposed shoulder means the diameter of which is greater than the mean diameter of said shaft, said shoulder means having a first side wall and a second side wall;

a drive end assembly which comprises a first endcasing, a first bearing housing, a first impeller housing and first impeller means, said drive end assembly being disposed about said shaft such that said first impeller means is adjacent to said first side wall of said shoulder means;

a first key means which is mounted to said shaft for the purpose of restricting the axial movement of said first impeller means about said shaft without restricting its linear movement;

first locking means for securing said first impeller means against said shoulder means;

a center housing disposed about said shoulder means of said shaft and adjacent to said drive end assembly;

at least one first securing means disposed between said drive end assembly and said center housing for affixing said drive end assembly to said center housing;

a non-drive end assembly which comprises a second endcasing, a second bearing housing, a second impeller housing and second impeller means, said non-drive end assembly being disposed about said shaft such that said second impeller means is adjacent to said second side wall of said shoulder means;

a second key means which is mounted to said shaft for the purpose of restricting the axial movement of said second impeller means about said shaft without restricting its linear movement;

second locking means for securing said second impeller means against said shoulder means; and at least one second securing means disposed between said non-drive end assembly and said center housing for affixing said non-drive end assembly to said center housing, wherein said first securing means is secured to said center housing independent of said second securing means.

2. The assembly according to claim 1 wherein said first securing means is a tie rod which is threadably connected to said center housing and mechanically connected to said first endcasing of said drive end assembly.

3. The assembly according to claim 1 wherein said second securing means is a tie rod which is threadably connected to said center housing and mechanically connected to said second endcasing of said drive end assembly.

4. The assembly according to claim 1 wherein said first and second impeller means are impellers having a plurality of blades and a rib means which is capable of connecting all of said blades together.

5. The assembly according to claim 4 wherein said plurality of blades is thirteen.

6. The assembly according to claim 4 wherein said blades have an arcuate configuration.

7. The assembly according to claim 1 wherein said first impeller means is a second stage impeller and said second impeller means is a first stage impeller.

8. The assembly according to claim 1 wherein said center housing comprises a discharge side plate and a suction side plate.

9. The assembly according to claim 1 wherein said first and second locking means are locking nuts threadably connected to said shaft.

10. A method for assembling a pump assembly which comprises:

placing a drive end assembly about a shaft having centrally disposed shoulder means the diameter of which is greater than the mean diameter of said shaft, a first key means and a second key means, said shoulder means having a first side wall and a second side wall wherein said drive end assembly is adjacent to said first side wall of said shoulder means, and said drive end assembly comprises a first endcasing, a first bearing housing, a first impeller housing and a first impeller means, wherein said first key means is mounted to said shaft for the purpose of restricting the axial movement of said first impeller means about said shaft without restricting its linear movement;

placing a center housing about said shoulder means and adjacent to said drive end assembly;

affixing said drive end assembly to said center housing by at least one first securing means;

placing a non-drive end assembly about said shaft wherein said non-drive end assembly is adjacent to said second side wall of said shoulder means, said non-drive end assembly comprises a second endcasing, a second bearing housing, a second impeller housing and a second impeller means, wherein said second key means is mounted to said shaft for the purpose of restricting the axial movement of said second impeller means about said shaft without restricting its linear movement; and affixing said non-drive end assembly to said center housing by at least one second securing means which is affixed to said center housing independent of said first securing means, whereby said drive end assembly is assembled or disassembled about said shaft independent of said non-drive end assembly.

11. The method according to claim 10 wherein said drive end assembly is disposed about said shaft such that said first impeller means is adjacent to said first side wall of said shoulder means.

12. The method according to claim 11 further comprising a step of securing said first impeller means against said shoulder means by first locking means.

13. The method according to claim 10 wherein said non-drive end assembly is disposed about said shaft such that said second impeller means is adjacent to said second side wall of said shoulder means.

14. The method according to claim 13 further comprising the step of securing said second impeller means against said shoulder means by second locking means.

15. The method according to claim 11 wherein said first securing means is a tie rod which is threadably connected to said center housing and mechanically connected to said first endcasing of said drive end assembly.

16. The method according to claim 13 wherein said second securing means is a tie rod which is threadably connected to said center housing and mechanically connected to said second endcasing of said non-drive end assembly.

17. The method according to claim 12 wherein said first locking means is a locking nut threadably connected to said shaft.

18. The method according to claim 14 wherein said second locking means is a locking nut threadably connected to said shaft.

* * * * *